US006412255B2

(12) United States Patent
Hidding et al.

(10) Patent No.: US 6,412,255 B2
(45) Date of Patent: Jul. 2, 2002

(54) METHOD AND APPARATUS FOR ASSEMBLING MAIL ITEMS WITH SELECTIVE ENVELOPE SELECTION

(75) Inventors: Gerhard Hidding, Heerenveen; René Scheltes; Bertus Karel Edens, both of Drachten, all of (NL)

(73) Assignee: Neopost B.V., Drachten (NL)

( * ) Notice: Subject to any disclaimer, the term of this patent is extended or adjusted under 35 U.S.C. 154(b) by 0 days.

(21) Appl. No.: 09/750,059

(22) Filed: Dec. 29, 2000

(30) Foreign Application Priority Data

Dec. 31, 1999 (NL) ..... 1014000

(51) Int. Cl.[7] ..... B65B 11/48
(52) U.S. Cl. ..... 53/460; 53/561
(58) Field of Search ..... 53/55, 381.5, 381.6, 53/381.7, 460, 561; 493/11

(56) References Cited

U.S. PATENT DOCUMENTS 4,817,368 A * 4/1989 DePasquale et al. ..... 53/460
5,090,671 A 2/1992 Gombault et al.
5,297,376 A 3/1994 Taguchi et al.
5,339,603 A 8/1994 Gombault et al.
5,362,037 A 11/1994 van der Werff et al.
5,772,194 A 6/1998 Huebler et al.

FOREIGN PATENT DOCUMENTS

EP 267608 11/1987
EP 781671 7/1997

* cited by examiner

*Primary Examiner*—Scott A. Smith
*Assistant Examiner*—Chukwurah Nathaniel
(74) *Attorney, Agent, or Firm*—Burns, Doane, Swecker & Mathis, L.L.P.

(57) ABSTRACT

For assembling mail items, a type of envelope is selected from different types. Another station is accordingly set and a flat object is packaged in an envelope of the selected type. Prior to the assembly of a series of mail items, a set of basic finishing instructions applying to the series is activated. This set contains a first and a second set of instructions, each for selecting a first respectively second one of the different types of envelopes and with an instruction for an associated first respectively second setting of the other station, and a selection criterion for selecting, per individual mail item, one of the sets of instructions. Thus, within the framework of a preset set of basic finishing instructions, another one of the available types of envelope can simply be selected per mail item to be assembled individually.

26 Claims, 4 Drawing Sheets

| SET OF BASIC FINISHING INSTRUCTIONS 1 | |
|---|---|
| READING SCANNER | OFF |
| ACTIVE HOLDERS | 1ST AND 3RD |
| PRINTER | OFF |
| INSTRUCTION SET 1<br>ENVELOPE HOLDER<br>FOLD SETTINGS | 1<br>1ST FOLD 100 mm<br>2ND FOLD 200 mm<br>TYPE OF FOLD: Z-FOLD |
| INSTRUCTION SET 2<br>ENVELOPE HOLDER<br>FOLD SETTINGS | 2<br>1ST FOLD 148 mm<br>2ND FOLD NO<br>TYPE OF FOLD: SINGLE, FRONT INSIDE |
| CRITERION INSTRUCTION SET 1 | STANDARD |
| CRITERION INSTRUCTION SET 2 | NUMBER OF SHEETS ≥ 3 |
| CRITERION INSTRUCTION SET 2 | SHEET FROM FOLDER 3 |

111 112 113 101 114 115 116 117 118

FIG. 2A

| SET OF BASIC FINISHING INSTRUCTIONS 2 | |
|---|---|
| READING SCANNER | ON |
| ACTIVE HOLDERS | 1ST, 2ND, 3RD, 4TH |
| PRINTER | ON |
| INSTRUCTION SET 1<br>ENVELOPE HOLDER<br>FOLD SETTINGS | 1<br>1ST FOLD 100 mm<br>2ND FOLD 200 mm<br>TYPE OF FOLD: Z-FOLD |
| INSTRUCTION SET 2<br>ENVELOPE HOLDER<br>FOLD SETTINGS | 2<br>1ST FOLD 148 mm<br>2ND FOLD NO<br>TYPE OF FOLD: SINGLE, FRONT INSIDE |
| CRITERION INSTRUCTION SET 1 | STANDARD |
| CRITERION INSTRUCTION SET 2 | NUMBER OF SHEETS ≥ 3 |
| CRITERION INSTRUCTION SET 2 | ERROR FREQUENCY 1 |
| CRITERION INSTRUCTION SET 2 | SCANNED PRINTING OF TYPE 23 |

111 112 113 102 114 115 116 117 119 120

FIG. 2B

FIG. 2C

| SET OF BASIC FINISHING INSTRUCTIONS 3 | | |
|---|---|---|
| READING SCANNER | OFF | 111 |
| ACTIVE HOLDERS | 1ST | 112 |
| PRINTER | ON | 113 |
| INSTRUCTION SET 1<br>ENVELOPE HOLDER<br>FOLD SETTINGS | 1<br>1ST FOLD 148 mm<br>2ND FOLD NO<br>TYPE OF FOLD: SINGLE, FRONT INSIDE | 114 |
| INSTRUCTION SET 2<br>ENVELOPE HOLDER<br>FOLD SETTINGS | 2<br>1ST FOLD 148 mm<br>2ND FOLD NO<br>TYPE OF FOLD: SINGLE, FRONT INSIDE | 115 |
| CRITERION INSTRUCTION SET 1 | PRINTING INSTRUCTION OF TYPE 34 | 121 |
| CRITERION INSTRUCTION SET 2 | PRINTING INSTRUCTION OF TYPE 12 | 122 |

103

FIG. 2D

| SET OF BASIC FINISHING INSTRUCTIONS 4 | | |
|---|---|---|
| READING SCANNER | OFF | 111 |
| ACTIVE HOLDERS | 1ST | 112 |
| PRINTER | ON | 113 |
| INSTRUCTION SET 1<br>ENVELOPE HOLDER<br>FOLD SETTINGS | 1<br>1ST FOLD 148 mm<br>2ND FOLD NO<br>TYPE OF FOLD: SINGLE, FRONT INSIDE | 114 |
| INSTRUCTION SET 2<br>ENVELOPE HOLDER<br>FOLD SETTINGS | 1ST FOLD -<br>2ND FOLD -<br>TYPE OF FOLD: - | 115 |
| CRITERION INSTRUCTION SET 1 | EACH | 126 |
| CRITERION INSTRUCTION SET 2 | ALWAYS OFF | 127 |

104

FIG. 2E

| SET OF BASIC FINISHING INSTRUCTIONS 5 | | |
|---|---|---|
| READING SCANNER | OFF | 111 |
| ACTIVE HOLDERS | 1ST en 3RD | 112 |
| PRINTER | OFF | 113 |
| INSTRUCTION SET 1<br>ENVELOPE HOLDER<br>POSTAGE CLASS | 1<br>A | 123 |
| INSTRUCTION SET 2<br>ENVELOPE HOLDER<br>POSTAGE CLASS | 2<br>B | 124 |
| FOLD SETTINGS | 1ST FOLD 148 mm<br>2ND FOLD NO<br>TYPE OF FOLD: SINGLE, FRONT INSIDE | 125 |
| CRITERION INSTRUCTION SET 1 | PRINTING INSTRUCTION OF TYPE 34 | 121 |
| CRITERION INSTRUCTION SET 2 | PRINTING INSTRUCTION OF TYPE 12 | 122 |

105

METHOD AND APPARATUS FOR ASSEMBLING MAIL ITEMS WITH SELECTIVE ENVELOPE SELECTION

BACKGROUND OF THE INVENTION

The invention relates to a method for assembling mail items, wherein from at least two different types of envelopes, one type of envelope is selected for packaging at least one flat object in an inserting station of a mail assembling apparatus, at least one other station of the mail assembling apparatus is set according to the selected type of envelope, and at least one flat object is packaged in an envelope of the selected type, and to an apparatus for applying said method.

Such method and such apparatus are known from U.S. Pat. No. 5,889,603. According to this document, the filling station comprises one or more envelope stock holders, feed means for feeding an envelope from one of those envelope stock holders, activating means for activating, per mail item to be assembled, a given envelope stock holder for feeding an envelope. These activating means are connected to the data processing means wherein an envelope selection program is stored. This program contains at least one input parameter for storing a parameter value representing the envelope height of an envelope present in one of the stock holders, at least one input parameter for storing a parameter value representing a property of a set of documents to the packaged, at least one input parameter for storing a reference value with which the last-mentioned parameter value can be compared, an output parameter for activating one of the envelope stock holders and an algorithm for designating a value to the output parameter for activating one of the envelope holders depending on the outcome of said comparison.

A parameter value on the basis of which a specific type of envelope is selected can, for instance, be the number of documents from which a set is or has been assembled. According as more documents are sent, a larger envelope can be selected, for instance to avoid folding a thick pack of documents. Another property on the basis of which a given type of envelope is selected, can for instance be the optional feed of a document from a given document delivery station. Documents from a given document delivery station can, for instance, be wholly or partially unfoldable, or bear the address on a position which is only compatible with a specific type of window envelope. Selecting an envelope on the basis of the optional feed of a document from a given document delivery station can, for instance, be effected in that a parameter value is associated with a document delivery station, which parameter value represents a height of an unfoldable part of a document to be fed through that feed station. If a document is fed from said document delivery station, this parameter value is used, during the selection of an envelope, as parameter value requiring a given minimum envelope height. When the folding height of folding heights are being determined, the length and place of an unfoldable part of a document are used for determining the folding height zones which cannot be used.

A further parameter on the basis of which an envelope is selected, can for instance be obtained by determining the weight of the relevant set of documents. In certain cases, it will be desirable to package a heavier set of documents in a large and/or firmer envelope, than a lighter set of documents. In practice, a larger envelope will virtually always have a height different from a smaller envelope, so that the number of folds to be made, and the folding heights thereof, should be determined starting from another, large envelope height.

For packaging documents in window envelopes, it is important that the address, after the address-bearing document has been inserted into the envelope, be properly visible behind the window. In so far as the position of the address in width direction is compatible with the position in width direction of the window of the envelope to be used, the orientation of the address-bearing document, the number of folds in that document and, if folding takes place, the folding height of at least one fold must be such that also in height direction, the address is moved to a position corresponding to the position of the window and faces the window.

When this method and apparatus are used, it is important that the correct data relating to the documents and envelopes to be processed be inputted for the relevant series of mail items. This is rather laborious and complicated and increases the chance of errors during the input of data.

SUMMARY OF THE INVENTION

It is an object of the invention to simplify the assembly of mail items with automative selection between two different types of envelopes which may have different sizes, and to reduce the chance of the occurrence of errors.

According to the present invention, this object is realized by providing a method for assembling mail items comprising:

designating, prior to the assembly of a series of mail items in an apparatus for assembling mail items, a precomposed set of basic finishing instructions applying to said series, said set of basic finishing instructions comprising: a first set of instructions comprising an instruction for an inserting station for selecting a first one of at least two types of envelopes and an instruction for an associated, first setting of another station of the apparatus, a second set of instructions comprising an instruction for an inserting station for selecting a second one of the at least two types of envelopes and an instruction for an associated, second setting of the at least one other station, and a selection criterion other than the settings of the at least one other station for selecting, per individual mail item, one of the sets of instructions;

selecting, per individual mail time of the series, one of the sets of instructions according to the selection criterion;

setting, according to the selected set of instructions; at least the other station of the apparatus; and packaging, per individual mail item, at least one flat object in an envelope of a type according to the set of instructions selected for said mail item.

To realize this object, the invention also provides a system for assembling mail items, including:

a delivery station for feeding flat objects individually; an inserting station downstream of the delivery station having at least two envelope feed provisions for feeding envelopes of at least two types in any desired order;

at least one other processing station in line with the inserting station; and a control system for setting the at least one other processing station according to the selected type of envelope;

wherein in the control system, at least one precomposed set of basic finishing instructions is stored which, prior to the assembly of a series mail items, can be designated as applying to that series, said set of basic finishing instructions comprising:

a first set of instructions comprising an instruction for selecting a first one of the at least two types of envelopes and an instruction for an associated, first setting of the at least one other station;

a second set of instructions comprising an instruction for selecting a second one of the at least two types of envelopes and an instruction for an associated, second setting of the at least one other processing station, and a selection criterion, other than the settings of the at least one other processing station, for selecting, per individual mail item, one of the sets of instructions.

Because settings of the other station associated with the insertion in a specific envelope type, together with the choice of that type of envelope, form part of a precomposed set of instructions, within the framework of a preset set of basic finishing instructions, another one of the available envelope types can readily be selected per mail item to be assembled individually. For this, the associated setting of the other station is then also selected automatically and the processing of an object or objects for that mail item is carried out by that other station operating according to that setting without this depending on the inputted data concerning starting materials or the like. Indeed, it is not necessary to couple instructions concerning the choice of a type of envelope to instructions for assembling a mail item. For that reason, the automatic envelope selection can be used with particular advantage in combination with specifications for assembling mail items without the need to couple, in those specifications themselves, instructions relating to the selection of an envelope to instructions for preparing an individual document.

Particularly advantageous embodiments of the invention are laid down in the dependent claims.

Hereinafter, further objects, practical aspects, effects and details according to the invention are further described on the basis of a practical example and with reference to the drawing.

BRIEF DESCRIPTION OF THE DRAWINGS

FIGS. 2A–2E show outlines of sets of basic finishing instructions.

DETAILED DESCRIPTION

Figure 1:
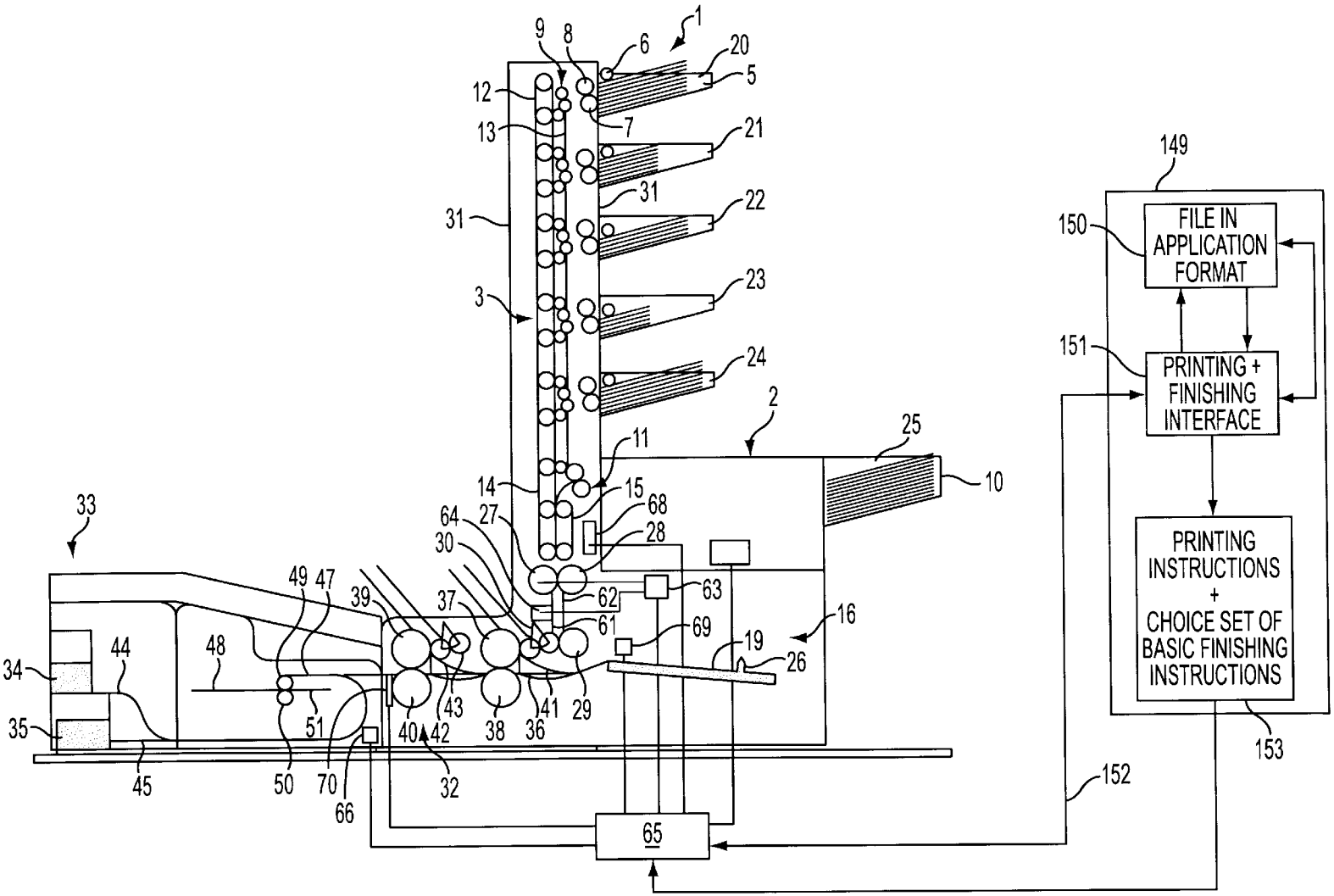
FIG. 1 is a schematic representation, in side elevation, of a system according to the invention.

The invention will first be explained with reference to the most preferred practical example, shown in FIG. 1, of a system according to the invention for assembling a mail item. In the drawing, parts occurring in multiple are designated by mutually identical reference numerals.

The system is provided with two feed stations 1, 2 for delivering sheet-shaped objects, in this examples in the form of documents in holders 20–25.

The upper feed station 1 has four feed sections. Each of the feed sections 1 comprises a holder 5, a supply roller 6, a separation roller 7, a transport roller 8 and a pair of delivery rollers 9. An example of a separation apparatus suitable for use in a delivery station according to the practical example shown, is described in more detail in U.S. Pat. No. 5,362,037, to which reference is being made.

The lower feed station is designed as a holder 10 for feeding sheets to be printed to a printer 2. Located directly downstream of the printer 2 is a pair of delivery rollers 11 for delivering, at suitable moment, a sheet printed by the printer 2. Preferably, the printer 2 is designed such that the printing of a sheet is in each case completed before the sheet reaches a waiting position between the delivery rollers 11. If necessary, the transport track between the printer 2 and the delivery rollers 11 can be extended for this purpose.

The feed sections 1 are each designed for retaining documents between rollers 9 and for subsequently delivering the documents to a vertical transport track 3 between a vertical conveyor 12 and press-on belts 13, 15.

The system further comprises an aligning station 16 for aligning documents associated with a specific set, into a stack whose document edges are substantially aligned on one side thereof.

The aligning station 16 is designed as a terminal station with a feed track, an aligning surface with a displaceable stop 26 and a discharge track 36 in line with the aligning surface 19. The feed track is formed by transport rollers 27, 28, 29, 30 and guides 61, 62. Via this feed track, documents supplied via the transport unit 4 can be passed to the aligning surface 19.

In supply direction, the documents can be conveyed to engage the stop 26 and, next, be discharged in opposite direction, the aligned documents edges forming the trailing edge of the stack. In the folding station 32, the place of each fold is in each case determined relative to the trailing edge of the stack of documents.

When a document has been slid against the stop 26 and a following document, a following document can also be slid against the stop. In this manner, successive documents can be aligned.

The system further comprises a folding station 32 for folding documents coming from the aligning station 16 and supplied, individually or as part of stacks whose documents edges are in each case aligned against the stop 26. In discharge direction from the stop 26, a first and second pair of folding rollers 37, 38 and 39, 40 are provided, with the discharge track 36 extending between the folding rollers 37, 38 and 39, 40. Provided between the stop 26 and the folding rollers 37, 38 and 39, 40 respectively are deflectors 41 and 42 for deflecting the documents coming from the stop 26, into a position between the relevant folding roller 37, 39 and the rollers 30, 43 respectively, for pressing a deflected portion of a document against an outer surface of that folding roller 37 or 39 respectively.

After the documents have been aligned, the stack is first displaced against the feed direction and subsequently to the folding station 32. The edge of the stack remote from the stop 26 and an adjoining portion of the stack can be deflected along a pair of folding rollers 37, 38 or 39, 40 and be clamped against the most adjacent folding roller 37 or 39 of the pair of folding rollers 37, 38 or 39, 40, whereupon the folding rollers are driven so that the deflected portion of the stack is bent through further and moved between the folding rollers, where a fold is provided in the stack.

The position of each fold can be accurately determined on the basis of the position of the edge of the stack on the side of the stop 26, which edge is in trailing position during transport of the stack to the folding station 32. By operating the pressure roller 30 depending on the position of the stop 26, the position of the folds can be determined in a simple and accurate manner.

A folding station and method of the type as described hereinabove are described in more detail in U.S. Pat. No. 5,090,671, to which reference is being made.

Connected to the folding station 32 is an inserting station 33. This inserting station 33 is provided with two envelope holders 34, 35 for receiving and delivering, piece by piece, different types of envelopes. To the envelope holders 34, 35, transport tracks 44, 45 connect, flowing together into a joint transport track 46 leading toward an inserting position 47. To the inserting position, a support surface 48 connects, from where filled envelopes can be moved, through and between closing rollers 49, 50, to a discharge track 51.

The discharge track 51 is oriented at right angles to the plane of the drawing. For a more detailed description of the inserting portion of the inserting station, reference is made to European patent specification 0 781 671.

For scanning delivered documents, scanning means for scanning a passing document to be gathered are provided downstream of the feed stations 1, 2 and upstream of the aligning station 16. According to the present practical example, the scanning means are designed as a scanner 64. This for instance enables scanning the printing patterns of a passing document, while variations in brightness of light reflected by a document and the rotation of one of the transport rollers 27 is registered.

The transport roller 27 and the scanner 64 are connected to a data processor 63 for inputting and storing a scanning result corresponding to the measured pattern of brightnesses. By transporting selected documents individually and gathering them downstream of the feed stations 1, 2 and upstream of the folding station 32, those documents can be scanned.

The data processor 63 is connected to a central control unit 65 (shown outside the housing of the system for clarity's sake) for controlling, partly on the basis of the scanning result, the folding station 32 and the inserting station 33 for selecting the proper envelope holder 34, 35 for delivering an envelope and for setting the folding station 32 in such a manner that the fed documents fit therein with a suitable clearance, while, if necessary, address data on the documents are visible behind a window in the envelope.

The data processor 63 connected to the scanner 64, the central control unit 65 and data processor 66–68 in the inserting station 33, the printer 2 and the feed station 1 form a control system wherein precomposed sets of basic finishing instructions 101–105 are stored which, prior to the assembly of a series of mail items, can be designated as applying to that series. Sets of basic finishing instructions can, for instance, be composed like the sets 101–105 shown in FIGS. 2A–2E.

In addition to instruction 111–113 concerning the condition of the scanner 63, the holders 20–24 and the printer 2, the sets of basic finishing instructions 101–105 further comprise instructions 114–127 concerning the selection of the holder 34, 35 controlled for delivering an envelope for inserting a document therein.

According to the example shown in FIG. 2A, the instructions concerning the selection of the holder 34, 35 which is controlled for delivering an envelope for inserting a document therein, consist of a first instruction set 114, a second instruction set 115 and instructions 116–118 concerning selection criteria on the basis of which either the first instruction set 114 or the second instruction set 115 should be chosen.

The first instruction set 114 and the second instruction set 115 each contain an instruction concerning the envelope holder 34, 35 from which an envelope is to be fed, with which it can be determined which of two types of envelopes in those holders 34, 35 will be used for inserting the documents or the documents of the relevant mail item.

Further, the first instruction set 114 and the second instruction set 115 each comprise an associated setting of another station. In this example, this is a setting of the folding station 32 with respect to the folds to be made and the places of those folds calculated from a trailing edge of the document or the documents.

The instructions concerning the criteria for selecting, per individual mail item, one of the two sets of instructions included in the set of basic finishing instructions 101, are formed by three instructions 116, 117 and 118.

Instruction 116 indicates that as standard selection, instruction set 1 should be chosen. Instructions 117 and 118 indicate that this standard should be deviated from if the number of sheets of a mail item is greater than three and if the mail item contains a sheet from holder No. 3 (in FIG. 1 the third holder 22 from the top). This last implies that with each individual mail item, instructions are associated (not shown) which determine directly or indirectly of how many sheets the mail item should exist and whether a sheet should be fed from the third holder 22. The reason for selecting a different envelope in the case where a document is fed from holder 3, may for instance be that documents from holder 3 are too thick for being folded twice or because documents from holder 3 bear a bending-stiff element, such as a membership card, which cannot be folded without being damaged.

Assembling mail items according to this example is carried out as follows.

Prior to the assembly of a series of mail items, one of the available, precomposed sets of basic finishing instructions is designated as set of basic finishing instructions applying to that series.

Next, the instructions for assembling the successive mail items are fed. These instructions can, for instance, consist of delivering documents from the upper (first) holder 20, with the number of sheets and the number of inserts that are fed being determined by data present on the documents from the upper (first) holder 20, for instance in the form of a barcode read by the scanner 64.

However, selecting a type of envelope from different types of envelopes in the inserting station 33 as envelope for packaging the documents takes place on the basis of the selected set of basic finishing instructions containing the selection criteria and the instruction sets with assignment of an envelope holder and associated fold settings. Thus, during the drawing up of an order for sending a series of mail items, no information concerning the choice of envelopes need be inputted and the automatic envelope choice per mail item can also be used in combination with systems having no provision for selecting the envelope choice as part of the instructions associated with individual mail items. Moreover, this involves automatic adaptation of the fold setting of the folding station 32 to the requirements inherent to a choice for a given type of envelope. Determining the sets of basic finishing instructions is preferably effected as service setting by skilled staff such as a serviceman or specially trained postroom staff. Other operators and users of the system need not worry about the inputting of data concerning sizes of envelopes and documents. To them, it is sufficient to follow user instructions indicating in which situation which set of basic finishing instructions should be selected. To this end, it is advantageous that several sets of basic finishing instructions are stored in the control system. Thus, designating a precomposed set of basic finishing instructions is effected by choosing from different sets of basic finishing instructions n.

Such sets of basic finishing instructions can, for instance, be specifically arranged for assembling mail items in response to requests for information, for assembling invoices, for sending policies with inserts. In practice, it appears that in an organization, only a fairly limited number of such sets of basic finishing instructions are used. Integrating the variable envelope selection as setting in a set of basic finishing instructions offers additional flexibility without confronting the average user or operator with a substantial increase of the complexity.

The scanner 64 may also be designed as a thickness gauge for measuring the thickness of a passing document to be gathered, which thickness gauge is connected to the data processor 63 for transmitting a signal corresponding to the measured thickness, to that data processor 63. The signal corresponding to the measured thickness can be compared with a reference signal so as to check whether one document has been delivered and is transported, or whether an error has occurred and more documents, or, conversely, no document has been delivered and is transported. When documents have mutually different thicknesses, it can also be checked whether the correct document has been delivered and is transported. The measured thicknesses can also serve as criterion for selecting an instruction set and, accordingly, a type of envelope. For instance, in response to a thickness greater than a given value, a type of envelope may be selected wherein the document fits without folding. In fact, when suitable sensors are present, other document properties, such as bending-stiffness, reflection, electric conductivity, transparency and gloss can also be used as criterion for selecting an instruction set activating either one or the other envelope holder 34, 35 for delivering an envelope serving for insertion.

It is also possible to measure the measured thicknesses of documents of a set of documents to be jointly inserted, and, for inserting those documents, selecting a large type of envelope if the summed thickness of the documents of the set of documents to be jointly inserted exceeds a given limit value. For that purpose, the system shown in FIG. 1 comprises a thickness gauge 69 in the area of the aligning station 16, coupled to the control unit 65.

It is also possible to measure the length of the documents and to have the choice of the envelope holder 34 or 35 partly depend on the lengths of the documents of a set which are to be inserted. In this manner, an automatic selection of an envelope, fitting in with the volume of the stack to be packaged, can be obtained.

Prior to the start of a run, a number of documents can be delivered each delivered document being individually transported and scanned downstream of the feed stations. Data relating to these documents obtained during scanning, such as the thickness and a scanned printing pattern, can be stored. These data can subsequently be used for controlling the system, for instance for selecting one of the envelope holders 34, 35 for delivering an envelope of a given size and for setting the folding station 32 accordingly.

The scanner 64 can also be used for determining which document is located in which holder 20–24 of the feed station 1. To that end, a scanning result obtained during the scanning of a passing document can be compared with known scanning results and for determining the associated document code. These codes are subsequently stored in a data processor in association with a holder code belonging to the holder whereby the scanned document is delivered. For one or more of the found document codes, it may for instance be predetermined which of the two envelope holders is to be controlled for delivering an envelope into which a document with that document code is to be inserted.

Figure 3:
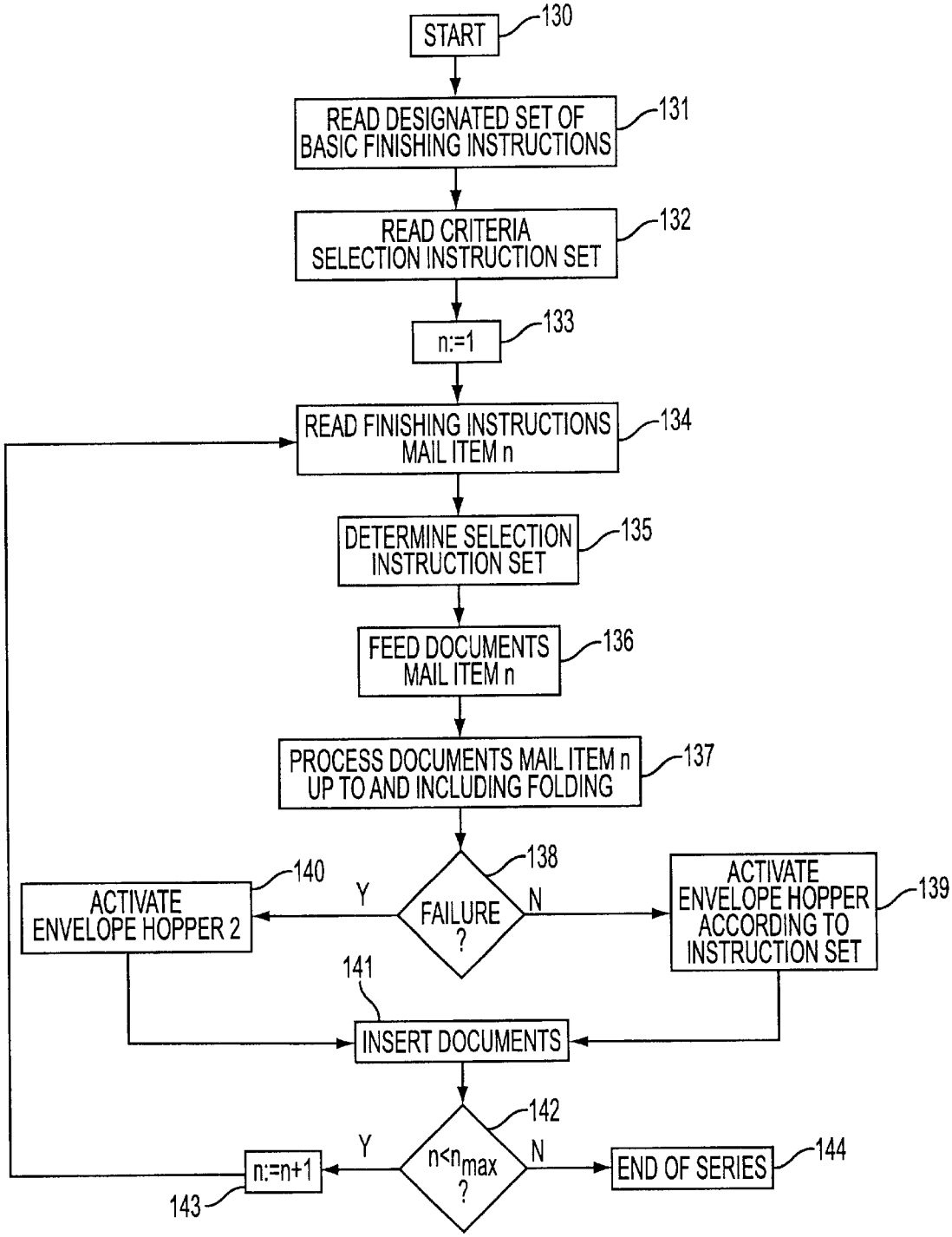
FIG. 3 shows an algorithm for selecting an envelope type depending on phenomena during processing.

FIG. 3 shows a particularly advantageous manner of carrying out the method according to the invention, wherein also, as selection criterion, the criterion whether a processing problem has occurred during the processing of a document is used.

After starting the method (step 130), the activated set of basic finishing instructions, applying to the series to be assembled, is read (step 131). This set of basic finishing instructions contains as one of the criteria for selecting an instruction set 2 including an instruction for using the second envelope holder 35, that a processing problem is registered by the control unit 65. Another selection criterion of this set of basic finishing instructions is that standard instruction set 1, including an instruction for using the first envelope holder 34, is selected.

The criteria for selection of instruction sets and also the contents of the instruction sets are subsequently read by the control system 65 (step 132). Further, a counter n is set to "1" (step 133). Next, the individual finishing instructions associated with the first mail item are read (step 134) and the criteria for selecting an instruction set are applied (step 135). The finishing instructions and the criteria could involve the situation that for a number of mail items, the second instruction set (and, accordingly, the second envelope holder) is selected, while for other mail items, the first instruction set (and, accordingly, the first envelope holder) is selected. However, as stated, according to this example, the first instruction set is given as standard (default) choice. Hence, step 135 in each case results in selecting the first instruction set. Next, documents are fed according to the finishing instructions, and, if required, printing instructions, associated with a mail item (step 136), and the documents are processed up to and including the folding operation in station 32 (step 137).

Subsequently, it is determined whether signals received from track monitoring sensors (not shown) give rise to registration of a failure message by the control system 65 (step 138). If no failure message is registered by the control system 65, the first envelope holder 34 is activated for delivering an envelope for insertion, as indicated by the first instruction set (step 139). However, if a failure message is indeed registered by the control system 65, envelope holder 2 is activated for delivering an envelope for insertion (step 140). After delivery of an envelope, regardless whether this is effected from the first or the second envelope holder, the instruction to insert the collected documents follows. If the detected failure has not been too serious, the insertion will generally succeed.

Finally, it is considered whether the assembled mail item is the last of a series (step 142). If this is not the case, the counter n is subsequently increased (step 143) and step 134 of reading a next set of finishing instructions, for instance from a memory or from a document, is returned to. If the assembled mail item is the last of a series, step 144 follows, whereby the assembly of a series of mail items is ended.

The effect achieved with this method is that documents or sets of documents which are suspicious in the sense that a processing problem has been observed in respect thereof, are packaged in envelopes other than documents or sets of documents for which this is not the case. By inspecting, after the assembly of a series of mail items has ended, the contents of the envelopes of the alternative type, it can readily be verified whether these envelopes contain the intended contents. A particular advantage of this method is that documents in respect of which a processing problem has been observed, are held together in the alternative envelope, which prevents documents of successive sets in respect of which a processing problem has been observed from mixing up easily.

If the envelopes of the other type are free of a flap, gumming or both, it is readily effected that envelopes whose contents are stigmatized as being potentially faulty, are not sealed up and hence remain accessible for inspection without having to be opened. It is not necessary to provide the inserting station with special arrangements for suppressing the moistening for such envelopes.

If for a given document or a given set of documents a processing problem has been observed, there is an increased chance that the document or the set of documents, after folding, does not fit in an envelope to which the fold settings are adjusted. For that reason, it is advantageous if the envelope of the alternative type into which the document or the document are inserted in response to a message of a processing problem, has such a size that the document or the set of documents fits into it in unfolded form. If necessary, in response to a message of a processing problem, a folding instruction can then also be suppressed.

As scanner for scanning processing problems, track monitoring sensors, not shown, may for instance serve. FIG. 1 further shows a scanner 70 coupled to the control unit 65 for signaling processing problems to the control unit 65. This scanner 70 measures the length of documents after folding and provides a signal when a document or a set of documents after folding has a length which deviates by more than a given extent from the expected length. The control unit contains the instructions as described hereinabove for selecting, in response to an observed processing problem, the second one of the envelope holders 34, 35 for delivering an envelope serving for inserting the document of the set of documents.

As selection criterion, it is also possible to use the criterion that a given instruction set is selected if during the assembly of earlier mail items having a given property corresponding to a property of the mail item to be assembled, processing problems have been observed at least to a certain degree. An example of a set of basic finishing instructions 102 having such selection criterion 119 is shown in FIG. 2B. This set of basic finishing instructions 102 is identical to the set of basic finishing instructions 102 according to FIG. 2A, except for the absence of selection criterion 118 according to FIG. 2A and the additional selection criteria 119 (error frequency during insertion into envelopes from envelope holder 1) and 120 (scanned printing is of a specific type).

For instance, it may turn out that during the insertion of sets of documents with a document from the second holder 21 into envelopes from the first envelope holder 34, relatively many processing problems occur during folding. If in the presence of a document from the second holder 21, the frequency of errors rises above a limit value stored as limit value of criterion 119, then, on the basis of selection criterion 119, during the feed of a document from the second holder 21, the second instruction set, i.e., activation of the second envelope holder and accordingly setting the folding station 32, is automatically switched over to, so that folding takes place only once and the documents are packaged in a larger envelope.

The set of basic finishing instructions 102 according to FIG. 2B further provides that the scanner 64 scans a printing from passing documents. The scanner 64 is coupled to the control unit 65 for transferring scanning signals to the control system. The control unit 65 is also designed for storing data representing a first scanning result, for comparing a second scanning result obtained by scanning a document with the first scanning result and for selecting a specific one of the instruction sets 114, 115 in response to a given minimum degree of correspondence between the second scanning result and the first scanning result represented by the stored data.

The first scanning results form results of scanning a setting condition and the second scanning results form a result of scanning a document to be inserted. If the second scanning results resembles to a sufficient degree a specific one of the first scanning results, the first or the second instruction set 114, 115 is selected. Because use is made of a learning step, documents for processing according to the first and the second instruction set can be distinguished without these documents being provided with special marks of a predetermined meaning with respect to the manner of finishing of the document.

Also the order of a mail item to be assembled in a series of mail items may be a criterion for packaging that mail item in a particular envelope. For instance, by packaging the first, the last and/or each $n^{th}$ (for instance $10^{th}$) envelope differently, the number of mail items in a series of mail items can readily be determined. However, the order in a series in response to which a given instruction set is selected can also be different one, such as a first or last mail item with an addressing in a particular region.

FIG. 2C shows a set of basic finishing instructions 103 wherein instructions sets 114, 115 differ from each other in that a different envelope holder is selected and in that according to the folding instructions for one instruction set, the printing is folded outwards and according to the folding instruction of the other instruction set, the printing is folded inwards. As criterion 121 for selecting the first instruction set, it applies that printing instructions of a given type should be present for controlling the printer 2. Those instructions can, for instance, serve for printing a particular logo or a particular postal code. Criterion 122, which applies to selecting the second instruction set, is comparable.

This enables detecting, at the level of the printing instructions, whether a document to be printed belongs to a category for inserting into an envelope from one holder, or for inserting into an envelope from the other holder. In turn, this offers the advantage that one the on hand, it is not necessary to scan the documents after printing, which is relatively slow and error-susceptible process, while on the other hand, it is not necessary to provide a wide variety of software to enable processing mail items generated under a wide variety of applications.

The stadiums in which instructions for assembling a mail item occur are shown in FIG. 1. In the first place, an editable application file 150 is present in a computer system 149. By means of printing and finishing interface software 151, one of the sets of basic finishing instructions present in the control unit 65 is selected (symbolized by a double arrow 152). In correspondence with the selected set of basic finishing instructions, the file is subsequently converted into printing and finishing instructions 153. These printing and finishing instructions 153 are then sent to the control unit 65 which subsequently, according to the selection criteria 121, 122, determines for each mail item to be assembled which of the instruction sets 114, 115 are used for the mail item.

As a matter of fact, it is also possible to carry out the application of the selection criteria in the computer system 149, in which case the printing and finishing instructions for successive mail items are successively sent to the control system.

The system further comprises a printer for printing sheet-shaped objects upstream of said inserting station, wherein the control system is designed for detecting the presence of predefined data in a digital file in an editable application format in accordance to which printing instructions for printing said flat object are determined, for determining printing instructions for printing said flat object in accordance with data in said digital file, and for selecting a specific one of said at least two types of envelopes in response to the detection of the presence of said predefined data in said digital file.

It is further possible, as selection criterion for selecting one of the instruction sets, to use the presence of predefined data in a digital file 150 in an edible application format, such as a word processing application generally known under the trademark Microsoft Word. In accordance with these data, the printing instructions for printing the documents for the series of mail items are determined.

When the required software is available, detecting the presence of predefined data in such digital file is very simple and can readily be performed a considerable time before the actual printing of the documents and assembly of the mail items. In turn, this offers the advantage that it can readily be effected that amply before the actual printing of the documents and assembly of the mail items, it can be known which numbers of different envelopes are needed to enable assembling the desired series of mail items.

FIG. 2D shows an example of a set of basic finishing instructions 104 which leads to inserting all documents into envelopes from the first envelope holder 114. To this end, as criterion 126 for selecting the first instruction set 114, the criterion "each" is used, while as criterion 126 for selecting the second instruction set 115, the criterion "always off" is used. Thus, with a set of basic finishing instructions 104 whose structure is specifically adjusted to determining per individual mail item which type of envelope is selected, a series of mail items can readily be assembled in a conventional manner and with a fixed envelope selection.

In the sets of basic finishing instructions 101–103, the other station whose setting belongs to a choice of a specific envelope holder is in each case a folding station capable of operating with different fold settings. In connection with the choice of an envelope of a specific size, the setting of the folding station is of particular importance, because it depends on the height of the envelope. Therefore, it is particularly advantageous to couple a preset fold setting to the choice of a specific type of envelope.

However, FIG. 2E illustrates one of various other possible settings of another station for which it is advantageous to couple it to a choice of a folding station. Hence, in this set of basic finishing instructions, the first instruction set 123 contains, apart from the choice of the first envelope holder 34, the setting of postage class A for a franking machine (not shown) downstream of the inserting station 33, while the second instruction set 124 contains, apart from the choice of the second envelope holder 35, the setting of postage class B for this or another franking machine downstream of the inserting station 33. In some countries, such combination of envelope choice and postage class is particularly useful, because in those countries, the relationship between weight and required postage for envelopes in different size classes is different. Other settings which can advantageously be coupled in instruction sets to the selection of a specific envelope type are, for instance, settings of the inserting station 33 in respect of sealing up or not sealing up an envelope, or in respect of the control of a discharge apparatus having several discharge tracks.

What is claimed is:

1. A method for assembling mail items comprising designating, prior to assembly of a series of mail items in an apparatus for assembling mail items, a precomposed set of basic finishing instructions applying to said series, the apparatus for assembling the mail items including a plurality of stations for processing the mail items or mail item parts, said plurality of stations including an inserting station and at least one other processing station, said set of basic finishing instructions comprising:

a first set of instructions comprising: a first envelope selection instruction for the inserting station for selecting a first one of at least two types of envelopes, and a first associated instruction for selecting an associated, first setting of said at least one other processing station, a second set of instructions comprising: a second envelope selection instruction for the inserting station for selecting a second one of said at least two types of envelopes, and a second associated instruction for setting an associated, second setting of said at least one other processing station, wherein said second associated instruction is different from said first associated instruction and wherein said associated, second setting is different from said associated, first setting, and a selection criterion other than said settings of said at least one other station, for selecting, per individual mail item, one of said sets of instructions;

selecting per individual mail item of said series, one of said sets of instructions according to said selection criterion;

setting, per individual mail item of said series, according to the selected set of instructions, said at least one other processing station;

processing, per individual mail item of said series, at least one object of the mail item by said at least one other processing station in accordance with said setting; and packaging, per individual mail item, at least one flat object in an envelope of a type according to the set of instructions selected for said mail item.

2. A method according to claim 1, wherein said associated setting of said at least one other processing station is a fold setting of a folding station.

3. A method according to claim 1, wherein said selection criterion is whether during processing of said at least one flat object, a processing problem has been registered.

4. A method according to claim 3, wherein one of said two types of envelopes are free of a flap or gumming.

5. A method according to claim 3, wherein envelopes of said other type have a size such that said at least one flat object fits therein in unfolded form.

6. A method according to claim 1, wherein said selection criterion is formed by the criterion whether during the assembly of earlier mail items having a specific property corresponding to a property of the mail item to be assembled, processing problems have be registered at least to a specific extent.

7. A method according to claim 1, wherein said selection criterion is formed by the criterion whether the mail item to be assembled has a specific order in a series of mail items to be prepared.

8. A method according to claim 7, wherein at least to one of the following orders is associated with said specific order: "first" , "n times an integer" and "last one of a series of mail items to be prepared".

9. A method according to claim 1, wherein said designation of a precomposed set of basic finishing instructions takes place through selection from at least two sets basic finishing instructions.

10. A method according to claim 1, wherein as said selection criterion, the presence of predefined printing instructions in instructions for printing said flat object applies, further comprising detecting the presence of said predefined printing instructions in said instructions for printing said flat object, and printing said flat object in accordance with said instructions for printing said flat object.

11. A method according to claim 1, wherein as said selection criterion applies: the presence of predefined data in a digital file in an edible application format in accordance with which instructions for printing said flat object are determined, further comprising detecting the presence of said predefined data in said digital file, determining instructions for printing said flat object in accordance with data in said digital file, and printing said flat object in accordance with said instructions of printing said flat object.

12. A method according to claim 1, further comprising scanning a printing of a flat object, wherein a first scanning result is obtained, storing data representing said first scanning result, determining, as selection criterion for at least one next flat object, a minimum degree of correspondence between a second scanning result obtained through scanning said next flat object and said first scanning result represented by said stored data, and scanning said next flat object, wherein said second scanning result is obtained.

13. A method for assembling mail items comprising:

designating, prior to assembly of a series of mail items in an apparatus for assembling mail items, a precomposed set of basic finishing instructions applying to said series, the apparatus for assembling the mail items including a plurality of stations for processing the mail items or mail item parts, said plurality of stations including an inserting station and at least one other processing station said set of basic finishing instructions comprising:

a first set of instructions comprising: a first envelope selection instruction for the inserting station for selecting a first one of at least two types of envelopes, and a first associated instruction for selecting an associated, first setting of said at least one other processing station, a second set of instructions comprising: a second envelope selection instruction for the inserting station for selecting a second one of said at least two types of envelopes, and a second associated instruction for setting an associated, second setting of said at least one other processing station, wherein said second associated instruction is different from said first associated instruction and wherein said associated, second setting is different from said associated, first setting, and a selection criterion other than said settings of said at least one other station, for selecting, per individual mail item, one of said sets of instructions;

selecting, per individual mail item of said series, one of sets of instructions according to said selection criterion;

setting, per individual mail item of said series, according to the selected set of instructions, said at least one other processing station;

processing, per individual mail item of said series, at least one object of the mail item by said at least one other processing station in accordance with said setting; and packaging, per individual mail item, at least one flat object in an envelope of a type according to the set of instructions selected for said mail item, wherein said selection criterion applies a location relative to a limit value of data representing a measured value of a property of a flat object.

14. A method as in claim 13, comprising:

measuring a value of property of a flat object, and comparing said measured value with said limit value.

15. A method for assembling mail items comprising;

designating, prior to assembly of a series of mail items in an apparatus for assembling mail items, a precomposed set of basic finishing instructions applying to said series, the apparatus for assembling the mail items including a plurality of stations for processing the mail items or mail item parts, said plurality of stations including an inserting station and at least one other processing station, said set of basic finishing instructions comprising:

a first set of instructions comprising: a first envelope selection instruction for the inserting station for selecting a first one of at least two types of envelopes, and a first associated instruction for selecting an associated, first setting of said at least one other processing station, a second set of instructions comprising: a second envelope selection instruction for the inserting station for selecting a second one of said at least two types of envelopes, and a second associated instruction for setting an associated, second setting of said at least one other processing station, wherein said second associated instruction is different from said first associated instruction and wherein said associated, second setting is different from said associated, first setting, and a selection criterion other than said settings of said at least one other station, for selecting, per individual mail item, one of said sets of instructions;

selecting, per individual mail item of said series, one of said sets of instructions according to said selection criterion;

setting, per individual mail item of said series, according to the selected set of instructions, said at least one other processing station;

processing, per individual mail item of said series, at least one object of the mail item by said at least one other processing station in accordance with said setting; and packaging, per individual mail item, at least one flat object in an envelope of a type according to the set of instructions selected for said mail item, wherein said selection criterion applies a location of the measured thickness of a stack of collected flat objects intended to be packaged in a joint envelope relative to a limit value.

16. A method as in claim 15, comprising:

measuring a thickness of a stack of collected flat objects intended to be packaged in a joint envelope, and comparing said measured thickness to said limit value.

17. A system for assembling mail items, comprising:

a plurality of processing stations for processing mail items or mail item parts, said plurality of processing stations comprising:

a delivery station for feeding flat objects individually;

an inserting station downstream of said delivery station having at least two envelope feed provisions for feeding envelopes of at least two types in any desired order; and at least one other processing station in line with the inserting station; and a control system for setting said at least one other processing station in accordance with a selected type of envelope;

wherein in said control system, at least one precomposed set of basic finishing instructions is stored which, prior to the assembly of a series of mail items, can be designated as applying to said series, said set of basic finishing instructions comprising:

a first set of instructions comprising: a first envelope selection instruction for selecting a first one of said at least two types of envelopes, and a first associated instruction for selecting an associated, first setting of said at least one other processing station, a second set of instructions comprising: a second envelope selection instruction for selecting a second one of said at least two types of envelopes, and a second associated instruction for selecting an associated, second setting of said at least one other processing station, wherein said second associated instruction is different from said first associated instruction, and wherein said associated, second setting is different from said associated, first setting, and a selection criterion other than said settings of said at least one other processing station, for selecting, per individual mail item, one of said sets of instructions.

18. A system according to claim 17, wherein said at least one other station is a folding station having different fold settings.

19. A system according to claim 17, further comprising a scanner for scanning processing problems, said scanner being connected to said control system for signaling processing problems to said control system, wherein said control system contains instructions for selecting, in response to an observed processing problem, a specific one of said at least two sets of instructions.

20. A system according to claim 17, wherein said control system is designed for registering processing problems in connection with properties of mail items to be assembled and for selecting an alternative one of said at least two sets of instructions, in response to the occurrence, to at least a specific degree, of processing problems in connection with specific properties of mail items to be assembled.

21. A system according to claim 17, wherein in said control system, at least two sets of basic finishing instructions are stored.

22. A system according to claim 17, further comprising a printer for printing sheet-shaped object upstream of said inserting station, wherein the control system is designed for detecting the presence of predefined printing instructions in instructions for printing said flat object, and for selecting a specific one of said at least two sets of instructions in response to the detection of the presence of said predefined printing instructions in said instructions for printing said flat object.

23. A system according to claim 17, further comprising a printer for printing sheet-shaped objects upstream of said inserting station, wherein the control system is designed for detecting the presence of predefined data in a digital file in an editable application format in accordance with which printing instructions for printing said flat object are determined, and for selecting a specific one of said at least two sets of instructions in response to the detection of the presence of said predefined data in said digital file.

24. A system according to claim 17, further comprising a scanner for scanning a printing of a flat object, said scanner being coupled to said control system for transferring scanning signals to said control system, wherein said control system is designed for storing data representing a first scanning result, for comparing a second scanning result obtained by scanning a next flat object with said first scanning result and for selecting a specific one of said at least two sets of instructions in response to a given minimum degree of correspondence between said second scanning result and said first scanning result represented by said stored data.

25. A system for assembling mail items, comprising:

a plurality of processing stations for processing mail items or mail item parts, said plurality of processing stations comprising:

a delivery station for feeding flat objects individually;

an inserting station downstream of said delivery station having at least two envelope feed provisions for feeding envelopes of at least two types in any desired order; and at least one other processing station in line with the inserting station; and a control system for setting said at least one other processing station in accordance with a selected type of envelope;

wherein in said control system, at least one precomposed set of basic finishing instructions is stored which, prior to the assembly of a series of mail items, can be designated as applying to said series, said set of basic finishing instructions comprising:

a first set of instructions comprising: a first envelope selection instruction for selecting a first one of said at least two types of envelopes, and a first associated instruction for selecting an associated, first setting of said at least one other processing station, a second set of instructions comprising: a second envelope selection instruction for selecting a second one of said at least two types of envelopes, and a second associated instruction for selecting an associated, second setting of said at least one other processing station, wherein said second associated instruction is different from said first associated instruction, and wherein said associated, second setting is different from said associated, first setting, and a selection criterion other than said settings of said at least one other processing station, for selecting, per individual mail item, one of said sets of instructions; and a thickness gauge for measuring a thickness of a stack of collected flat objects intended for being packaged in a joint envelope, said thickness gauge being coupled to said control system for transferring measuring signals to said control system, wherein said control system is designed for comparing data representing said measuring signals with a limit value and for selecting a specific one of said at first and second sets of instructions in respond to a measured value beyond said limit value.

26. A system for assembling mail items, comprising:

a plurality of processing stations for processing mail items or mail item parts, said plurality of processing stations comprising:

a delivery station for feeding flat objects individually;

an inserting station downstream of said delivery station having at least two envelope feed provisions for feeding envelopes of at least two types in any desired order; and at least one other processing station in line with the inserting station; and a control system for setting said at least one other processing station in accordance with a selected type of envelope;

wherein in said control system, at least one precomposed set of basic finishing instructions is stored which, prior to the assembly of a series of mail items, can be designated to applying to said series, said set of basic finishing instructions comprising:

a first set of instructions comprising: a first envelope selection instruction for selecting a first one of said at least two types of envelopes, and a first associated instruction for selecting an associated, first setting of said at least one other processing station, a second set of instructions comprising: a second envelope selection instruction for selecting a second one of said at least two types of envelopes, and a second associated instruction for selecting an associated, second setting of said at least one other processing station, wherein said second associated instruction is different from said first associated instruction, and wherein said associated, second setting is different from said associated, first setting, and a selection criterion other than said settings of said at least one other processing station, for selecting, per individual mail item, one of said sets of instructions; and a detector for measuring a value of a property of a flat object, said detector being coupled to said control system for transferring measuring signals to said control system, wherein the control system is designed for comparing data representing said measuring signals with a limit value and for selecting a specific one of said at least two sets of instructions in response to a measured value beyond said limit value.

* * * * *